US012139182B2

(12) United States Patent
Buchinger et al.

(10) Patent No.: US 12,139,182 B2
(45) Date of Patent: Nov. 12, 2024

(54) SENSOR ARRANGEMENT

(71) Applicant: Frauscher Sensortechnik GmbH, St. Marienkirchen (AT)

(72) Inventors: Gerald Buchinger, Schärding (AT); Lorenz Klausmann, Rainbach im Innkreis (AT)

(73) Assignee: Frauscher Sensortechnik GmbH, St. Marienkirchen (AT)

( * ) Notice: Subject to any disclaimer, the term of this patent is extended or adjusted under 35 U.S.C. 154(b) by 924 days.

(21) Appl. No.: 17/273,710

(22) PCT Filed: Sep. 3, 2019

(86) PCT No.: PCT/EP2019/073446
§ 371 (c)(1),
(2) Date: Mar. 4, 2021

(87) PCT Pub. No.: WO2020/048967
PCT Pub. Date: Mar. 12, 2020

(65) Prior Publication Data

US 2021/0347395 A1 Nov. 11, 2021

(30) Foreign Application Priority Data

Sep. 6, 2018 (EP) ..... 18192994

(51) Int. Cl.
*B61L 1/16* (2006.01)
*B61L 1/08* (2006.01)

(52) U.S. Cl.
CPC ..... *B61L 1/165* (2013.01); *B61L 1/08* (2013.01)

(58) Field of Classification Search
CPC .... B61L 1/02; B61L 1/165; B61L 1/16; B61L 1/163; B61L 1/08
See application file for complete search history.

(56) References Cited

U.S. PATENT DOCUMENTS 5,330,136 A 7/1994 Colbaugh
5,468,126 A 11/1995 Lukich
5,628,479 A * 5/1997 Ballinger ..... B61L 1/165 324/179
7,075,427 B1 7/2006 Pace et al.
(Continued)

FOREIGN PATENT DOCUMENTS

AT 502019 B1 1/2007
CN 2276440 Y 3/1998
(Continued)

OTHER PUBLICATIONS

Brazilian Office Action for Application No. BR112021003230-4, dated Aug. 1, 2023, 7 pages including translation.
(Continued)

*Primary Examiner* — Zachary L Kuhfuss
*Assistant Examiner* — Cheng Lin
(74) *Attorney, Agent, or Firm* — Morgan, Lewis & Bockius LLP

(57) ABSTRACT

A sensor arrangement (20) comprises a wheel sensor (21) which is arranged to detect wheels of rail vehicles, a carrier (22), and a connector (23), wherein the wheel sensor (21) is fixed on the carrier (22), the connector (23) is fixed to the carrier (22), and the connector (23) is electrically connected with at least one electrical contact (24) of the wheel sensor (21).

20 Claims, 4 Drawing Sheets

(56) References Cited

U.S. PATENT DOCUMENTS

Figure 1A:
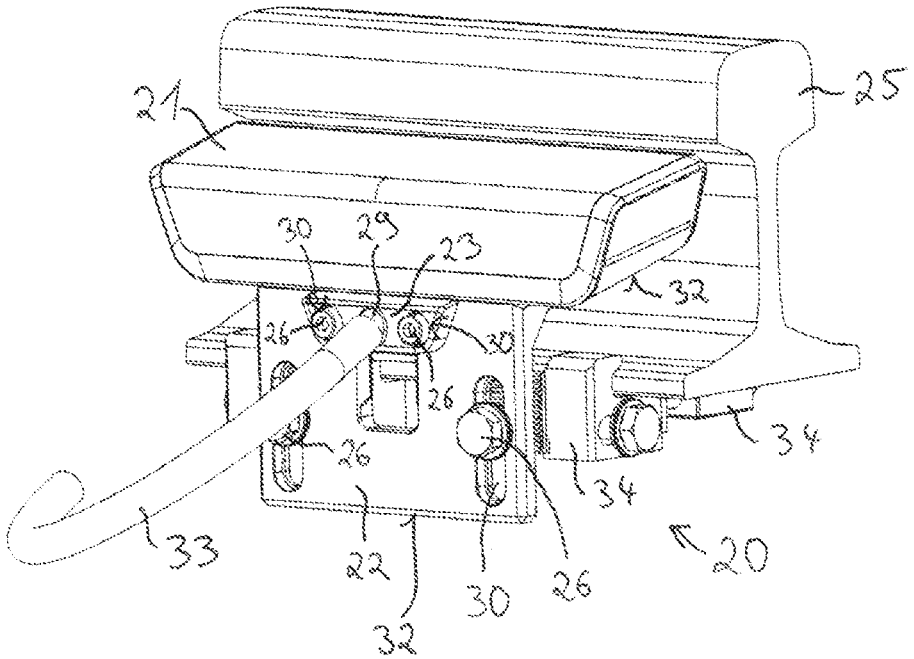

| | | | | |
|---|---|---|---|---|
| 7,717,004 | B2 * | 5/2010 | Kumar | H03M 7/30 73/866.5 |
| 2004/0023550 | A1 | 2/2004 | Frisch | |
| 2005/0072252 | A1 * | 4/2005 | Kumar | B61L 1/02 73/866.5 |
| 2011/0210213 | A1 | 9/2011 | Freise | |
| 2014/0165727 | A1 | 6/2014 | Mueller et al. | |
| 2015/0284015 | A1 * | 10/2015 | Lingvall | B61L 25/04 246/124 |
| 2018/0304679 | A1 * | 10/2018 | Broadfield | B60B 3/165 |

FOREIGN PATENT DOCUMENTS

| | | | | |
|---|---|---|---|---|
| CN | 2813396 | Y | 9/2006 | |
| CN | 2825395 | Y | 10/2006 | |
| CN | 201224414 | Y | 4/2009 | |
| CN | 101688880 | A | 3/2010 | |
| CN | 103518021 | | 1/2014 | |
| CN | 204548159 | | 8/2015 | |
| CN | 204915722 | | 12/2015 | |
| CN | 205022608 | U | 2/2016 | |
| CN | 207027286 | U | 2/2018 | |
| DE | 3234651 | A1 | 5/1984 | |
| DE | 19736180 | A1 | 3/1999 | |
| EP | 1808531 | A1 * | 7/2007 | B61L 1/02 |
| EP | 1960603 | A1 | 8/2008 | |
| EP | 3297888 | B1 | 3/2018 | |
| EP | 3567161 | A1 * | 11/2019 | B61L 1/02 |
| JP | 2005-233050 | | 9/2005 | |
| JP | 2007170966 | A | 7/2007 | |
| PL | 228830 | B1 | 11/2016 | |
| RU | 2627256 | | 8/2017 | |
| SU | 1463603 | A1 | 3/1989 | |
| WO | WO-2007127132 | A1 | 11/2007 | |
| WO | WO2016/184908 | A1 | 11/2016 | |

OTHER PUBLICATIONS

Notification to go Through Formalities of Registration for Chinese Application No. 201980057972.5, dated Jul. 19, 2023, 4 pages including translation.

Indian Office Action from Indian Patent Application No. 202127009012, dated Sep. 15, 2021, 5 pages.

Russian Decision on Grant from Russian Patent Application No. 2021108435, dated Sep. 3, 2021, 17 pages including English language translation.

Chinese First Office Action dated Jun. 6, 2022, and International Search Report dated May 26, 2022, in Application No. CN2019800579725, 17 pages, including English Translation.

Harting Technology Group, "Harting—User's Guide Transportation", 1st Edition 2010, 9 pages.

https://web.archive.org/web/20161008154302/https://www.rynek-kolejowy.pl/mobile/voestalpine-buduje-nowa-fabryke-pod-gdanskiem-78411.html, Oct. 3, 2016.

Printout from webpage uniac2, 11 pages, having notary public's date of Apr. 28, 2023.

Dispatch Note, Apr. 3, 2018, 2 pages.

Packlist, Order No. 70118266 Poa.20, 40, 80 & 510, Voestalpine Signaling Siershahn GmbH, Mar. 28, 2018, 1 page.

Invoice No. 70641122, Voestalpine Signaling Siershahn GmbH, Aug. 2, 2018, 2 pages.

Letter of Recommendation re Certificae of acceptance of the voestalpine wheel sensor UniAS2, Feb. 23, 2021, 1 page.

Katownik (metalurgia)—Wikipedia, wolna encyklopedia, https://pl.wikipedia.org/wiki/K%C4%85townik_(metalurgia), Apr. 28, 2023, 2 pages.

Michalak, "Performance Report, UNIAC2 Axle Counting System. OBB Trial Pernegg," Mar. 23, 2018, 8 pages.

UniAS2 Wheel Sensor Unit, Installation instruction by voestalpine Signaling Sopot Sp. z o.o., internal document approved on Sep. 28, 2016.

Drawings of sensor UNIAS.

Sun, X. et al.: "Applications of Aluminum Alloys in Rail Transportation", Advanced Aluminum Composites and Alloys, IntechOpen, 2021, pp. 1-18.

Grounds of Appeal, Appeal No. T0506/23-3.5.05, EP Application No. 18192994.4, May 8, 2023.

Reasons for Appeal, Appeal No. T0506/23-3.5.05, EP Patent No. 3620346, Apr. 28, 2023.

Office Action of Chinese Application No. 201980057972.5, dated Mar. 20, 2023, 12 pages including translation.

Search Report of Chinese Application No. 201980057972.5, dated Mar. 14, 2023, 2 pages.

Chinese First Office Action and Search Report in Application No. 2019800579725 dated Jun. 6, 2022, 17 pages including English Translation.

English Translation of PL-228830-B1, published Nov. 21, 2016, 7 pages.

https://altpro.com/automatic-train-protection/indusi-systems/ Trackside part of Indusi Systems from Altpro, HRWayback machine: ab 2021.

https://cs.wikipedia.org/wiki/Indusi#/media/Soubor:Indusi-Gleismagnet.JPG Example photo of trackside part of Indusi/PZB system from unknown company, Jul. 16, 2004.

Trackside part of SHP system from Kombud, PL, Oct. 24, 2013 https://kurier-kolejowy.pl/aktualnosci/16614/kombud-dostarczy-pkp-plk-urzadzenia-shp.html.

https://web.archive.org/web/20180718001535/https://www.eib-t.de/lexikon/pzb.htm, Jul. 18, 2018.

https://www.bahntechnik-bahnbetrieb.de/tag/indusi/ Example photo of trackside part of Indusi system from unknown company, Dec. 31, 2020.

https://www.rosenheim24.de/rosenheim/mangfalltal/bad-aibling-ort28271/bad-aibling-so-funktioniert-sicherungssystem-das-auf-der-bahnstrecke-einsatz-ist-6108845.html, 2016.

https:/www.gimota.com/news/trako-poland-2017.html (screenshot of 1st page), 2017.

https:/www.showmecables.com/mini-6-pin-din-female-solder-panel-mount-connector-metal, 2021.

Specification Sheet dated Apr. 15, 1999 for Mini 6 Pin DIN Female Solder Panel Mount Connector—Metal, Show Me Cables.

http://www.switchcraft.com/Category.aspx?Parent=803 as available on Jun. 12, 2017 https://web.archive.org/web/20170612224200/http://switchcraft.com/Category.aspx?Parent=803.

http://www.neutrik.com:80/en/industrial/xlr/dl-series/nc3md-l-bag-1 as available on Feb. 12, 2018 https:web.archive.org/web/20180212100119/http://www.neutrik.com:80/en/industrial/xlr/dl-series/nc3md-l-bag-1.

http://www.neutrik.com:80/en/industrial/xlr/xlr-chassis-connectors/p-series/ as available on Jan. 1, 2018 https://web.archive.org/web/20180101194925/http://www.neutrik.com:80/en/industrial/xlr/xlr-chassis-connectors/p-series/.

http://www.sealconusa.com:80/products/circular-connectors/m23-power/8/male-thread/ as available on Aug. 6, 2015 https://web.archive.org/web/20150806173630/http://www.sealconusa.com:80/products/circular-connectors/m23-power/8/male-thread/.

Catalogue Amphenol Filter Connectors as available on Nov. 16, 2014 on webpage https://powell.com/App_Themes/default/docs/catalog/amphcanadafilteredconn.pdf, 74 pages.

https://web.archive.org/web/20141116121840/https://powell.com/App_Themes/default/docs/catalog/amphcanadafilteredconn.pdf, as available on Nov. 16, 2014.

Catalogue Amphenol PCD as available on Nov. 10, 2014 on webpage https://powell.com/App_Themes/default/docs/catalog/amphpcdmaincat.pdf.

https://web.archive.org/web/20141110050346/https://powell.com/App_Themes/default/docs/catalog/amphpcdmaincat.pdf, as available on Nov. 10, 2014.

Positronic Connector Excellence—2017 Product Catalogue, 42 pages.

Brief Communication re Oral proceedings scheduled for Nov. 10, 2022 with Letter from the opponent in Application No. 18192994.4, dated Nov. 7, 2022, and Consolidated List in Application No. 18192994.4, dated Nov. 7, 2022, 11 pages.

(56) References Cited

OTHER PUBLICATIONS

Brief Communication—Letter from the opponent O2 in Application No. 18192994.4, dated Sep. 15, 2022, 22 pages.
Brief Communication—Letter from the opponent O1 in Application No. 18192994.4, dated Sep. 14, 2022, 30 pages.
Interlocutory decision in Opposition proceedings in Application No. 18192994.4, dated Jan. 4, 2023, 133 pages.
Zurkowski, A., "High-Speed Rail in Poland: Advances and Perspectives", Chapter 12.5. Polish control command system, Taylor & Francis Group, London, UK; Aug. 28, 2018.
https://web.archive.org/web/20180718001535/https://www.eib-t.de/lexikon/pzb.htm, Point shapes Train control (PZB), Indusi, as available on Jul. 18, 2018.
Intermittent automatic train control, Dec. 16, 2017 https://www.youtube.com/watch?v=vD2gXPZhpgQ&t=17s.
Documents of proof of public prior use—photographs of trade fair stand, Sep. 15, 2022 Opponent Submission.
ELS-96, Technical documentation of the wheel sensor, Bombardier Transportation (ZWUS) Polska Sp. z o.o., Jul. 15, 2016, 15 pages.
UNIAC1 Axle Counting System Brochure, 2015, voestalpine Nortrak Inc., 4 pages.
"Voestalpine Railway System (Beijing) at the Rail + Metro China, 2017 exhibition," www.voestalpine.com/blog/en/mobility/railways/voelstapine-railway-system-beijing-at-the-rail-metro-china-2017-exhibition, 2 pages.
Theeg, Gregor, et al., "Railway Signalling & Interlocking," International Compendium, 2nd Edition, PMC Media House GmbH, 2018, first published Dec. 18, 2017, 464 pages.
Communication of a Notice of Opposition in Application No. 18192994.4 dated Oct. 19, 2021, 56 pages.
Communication of a Notice of Opposition in Application No. 18192994.4 dated Oct. 29, 2021, 20 pages.
Summons to attend oral proceedings pursuant to Rule 115(1) EPC in Application No. 18192994.4, dated May 4, 2022, 18 pages.

* cited by examiner

SENSOR ARRANGEMENT

The present application relates to a sensor arrangement.

In order to monitor the movement of rail vehicles such as trains, wheel sensors can be employed. A wheel sensor is fixed to a rail and arranged to detect metallic or electrically conductive material moving in the vicinity of the wheel sensor. This means, the wheel sensor is configured to detect a wheel of a rail vehicle which passes the position of the wheel sensor.

As the wheel sensor is permanently fixed to the rail it needs to withstand different weather conditions. Furthermore, the wheel sensor is required to withstand the mechanical vibrations caused by moving rail vehicles and other external influences.

For supplying the wheel sensor with power the wheel sensor can be connected to a power cable. Therefore, also the connection between the wheel sensor and the power cable is required to be very stable and to withstand different weather conditions and other external influences.

It is an objective to provide a sensor arrangement with an improved mechanical stability.

This objective is achieved with the independent claim. Further embodiments are the subject of dependent claims.

In at least one embodiment of the sensor arrangement the sensor arrangement comprises a wheel sensor which is arranged to detect wheels of rail vehicles. This can mean that the wheel sensor is arranged to detect the presence of a wheel of a rail vehicle in the vicinity of the wheel sensor. The wheel sensor can be arranged at a fixed position along a railway track. The wheel sensor can be configured to detect if a wheel of a rail vehicle is present at the position of the wheel sensor. The wheel sensor can further be configured to detect if a wheel of a rail vehicle passes the position of the wheel sensor. The wheel sensor can further be arranged to provide the information that a wheel of a rail vehicle is detected. This information can for example be provided to a monitoring unit for monitoring rail traffic.

The wheel sensor can comprise a housing. The housing can comprise a plastic material. The housing can surround the wheel sensor from different sides.

The sensor arrangement further comprises a carrier. The carrier can comprise a metal or an alloy comprising at least one metal. The carrier can further comprise holes or recesses in which screws can be arranged to fix other parts of the sensor arrangement to the carrier.

The sensor arrangement further comprises a connector. The connector can comprise a plastic material. The connector can further comprise at least one plug. The plug can be configured to be connected with at least one electrical contact of the wheel sensor. The connector can be connected to a power cable for supplying the wheel sensor with power.

The wheel sensor is fixed on the carrier. This can mean, that the wheel sensor is mechanically connected with the carrier. That the wheel sensor is fixed on the carrier can mean that the wheel sensor is arranged on a topmost part of the carrier. The wheel sensor can be mounted on the carrier.

The connector is fixed to the carrier. The connector can be arranged at least partially within a recess or a hole of the carrier. The connector can be mechanically connected with the carrier. Furthermore, the connector can be in direct contact with the carrier. The connector can be fixed to the carrier independently from the wheel sensor. This means, the connector is directly fixed to the carrier and not via the wheel sensor. It is further possible that the connector is in direct contact with the wheel sensor. The connector can be reversibly fixed to the carrier.

The connector is electrically connected with at least one electrical contact of the wheel sensor. This means, the connector can comprise a plug which is electrically connected with at least one electrical contact of the wheel sensor. The wheel sensor comprises at least one electrical contact for electrically contacting the wheel sensor. This means, the wheel sensor can be supplied with power via the electrical contact. The connection between the connector and the electrical contact of the wheel sensor can be reversible.

The mechanical stability of the sensor arrangement is improved by fixing the wheel sensor to the carrier and by fixing the connector to the carrier. If a power cable is connected to the sensor arrangement a movement of the power cable can exert a force on the sensor arrangement. The power cable can be moved for example by parts hanging down from a passing rail vehicle or by humans or animals walking on the rail track. As the connector is fixed to the carrier independently from the wheel sensor, the connector is mechanically decoupled from the wheel sensor. A force exerted on the connector via the power cable can be mostly transferred to the carrier. This means, only a small amount of the force or no force is transferred to the wheel sensor. The wheel sensor can comprise a housing comprising a plastic material and the wheel sensor can comprise other sensitive parts. The wheel sensor is in this way advantageously protected from a damage caused by a movement of the power cable. A damage of the wheel sensor or of the housing could lead to a damage of the electrical connection between the connector and the wheel sensor. Thus, by fixing the wheel sensor to the carrier and by fixing the connector to the carrier the mechanical stability of the electrical connection between the connector and the wheel sensor is improved.

Another advantage is that the wheel sensor and the connector can be mounted to the carrier separately from each other. Therefore, for maintenance or for repairing a part the wheel sensor and the connector can be removed separately from each other from the sensor arrangement. It is further possible to remove or to mount the wheel sensor and the connector in a desired order from or to the sensor arrangement.

In at least one embodiment of the sensor arrangement the sensor arrangement is configured to be fixed to a rail. The sensor arrangement can comprise a clamp part which is configured to be fixed to a rail. The clamp part can be fixed to the carrier. The clamp part can be configured to be fixed to a rail at the side of the rail which faces away from the side where wheels of rail vehicles are passing. This means, the clamp part is arranged below the rail. The clamp part can comprise a metal or an alloy comprising at least one metal. The clamp part and the carrier can be connected via at least one screw. As the carrier and the clamp part are connected with each other a force exerted on the sensor arrangement by a power cable connected to the connector can be transferred from the connector to the carrier and to the clamp part. In this way, the wheel sensor is protected from the force exerted on the sensor arrangement.

In at least one embodiment of the sensor arrangement the wheel sensor comprises an inductive sensor. An inductive sensor can be capable of detecting a change of a magnetic field induced by metal moving in the magnetic field. The metal moving in the magnetic field can be the wheel of a rail vehicle. It is possible that the wheel sensor comprises the inductive sensor and a further inductive sensor. In this way, the velocity and the direction of travel of the rail vehicle passing the wheel sensor can be determined. Furthermore, in case of failure of one of the inductive sensors it is safer to employ at least two inductive sensors. This means, employing an inductive sensor enables the detection of rail vehicles passing the wheel sensor.

In at least one embodiment of the sensor arrangement the wheel sensor is fixed to the carrier by at least one screw. The carrier can comprise a hole in which the screw is arranged at least partially. It is further possible that the wheel sensor is fixed to the carrier by at least two screws. The connection via screws allows to reversibly fix the wheel sensor on the carrier in a stable way.

In at least one embodiment of the sensor arrangement the at least one screw is arranged at one side of the wheel sensor. This can mean, that the at least one screw is arranged at exclusively one side of the wheel sensor. The screw does not extend through the whole wheel sensor but only through a part of the wheel sensor. Consequently, only at one side of the wheel sensor space is required for the screw.

In at least one embodiment of the sensor arrangement the carrier comprises a first mounting part on which the wheel sensor is arranged. The first mounting part can comprise at least one hole in which the screw for fixing the wheel sensor to the carrier is at least partially arranged. The first mounting part can comprise a surface which runs parallel to a surface of the wheel sensor which faces away from the first mounting part. The first mounting part can be an integral component of the carrier. Furthermore, the first mounting part can comprise a recess in which the connector is partially arranged. The first mounting part can enclose an angle of 0° to 45° with the ground on which the sensor arrangement is arranged. The wheel sensor is arranged on the side of the first mounting part which faces away from the ground on which the sensor arrangement is arranged. Therefore, the wheel sensor is advantageously kept on the carrier by gravity and by the at least one screw.

In at least one embodiment of the sensor arrangement the carrier comprises a second mounting part to which the connector is fixed. The second mounting part can comprise a recess in which the connector is partially arranged. The second mounting part can be an integral part of the carrier. Furthermore, the second mounting part can be connected with the clamp part. The clamp part and the second mounting part can be connected with each other by screws. The second mounting part can be adjusted with respect to the clamp part in such a way that the distance of the first mounting part from the ground on which the sensor arrangement is arranged can be adjusted. As the second mounting part is connected with the clamp part, a force exerted on the sensor arrangement via a power cable which is connected to the connector can be transferred to the clamp part via the second mounting part.

In at least one embodiment of the sensor arrangement the first mounting part extends parallel to a first plane which encloses an angle of greater than zero degrees with a second plane, where the second mounting part extends parallel to the second plane. This means, the first mounting part mainly extends parallel to the first plane and the second mounting part mainly extends parallel to the second plane. For example, the first mounting part extends further in a plane which is parallel to the first plane than in any other direction. The second mounting part can extend further in a plane which is parallel to the second plane than in any other direction. The first plane and the second plane can enclose an angle of at least 20°. It is further possible that the first plane the second plane enclose an angle of at least 45° and at most 120°. In this way, the wheel sensor is stably fixed to the carrier and protected against vibrations caused by a moving rail vehicle.

In at least one embodiment of the sensor arrangement the connector is reversibly fixed to the carrier by at least one screw. It is further possible that the connector is reversibly fixed to the carrier by at least two screws. The connector can be fixed to the second mounting part by the screw. The connector can be fixed to the carrier by the screw. This means, the connector is fixed to the carrier by the screw and to no other part of the sensor arrangement. The connection via the screw or via at least two screws enables a stable connection of the connector to the carrier. Furthermore, the connector can reversibly be fixed to the carrier.

In at least one embodiment of the sensor arrangement the connector comprises an electrical contact. The electrical contact is arranged to be connected to a power cable. That can mean that a power cable can be connected to the electrical contact. Therefore, the electrical contact is arranged at a side of the carrier which faces away from the rail. A power cable can be fixed reversibly or irreversibly to the connector. For example, the power cable is fixed to the connector by molding or injection molding. The power cable is fixed to the connector in such a way that it is electrically connected with the electrical contact. The power cable can be employed for supplying the wheel sensor with power. Advantageously, the power cable is fixed to the connector. Thus, stress exerted on the power cable, for example by a movement of the power cable, is not directly transferred to the wheel sensor.

In at least one embodiment of the sensor arrangement the electrical contact is arranged closer to a bottom side of the carrier than the wheel sensor. The bottom side of the carrier can be the side which is the closest to the ground on which the sensor arrangement is arranged. The bottom side of the carrier faces away from the wheel sensor. That the electrical contact is arranged closer to the bottom side than the wheel sensor can mean that the electrical contact is arranged lower on the carrier than the wheel sensor. This arrangement is advantageous as it is less likely for parts of passing rail vehicles or humans or animals walking on the railway track to touch the power cable which is connected to the electrical contact than for a higher position of the electrical contact.

In at least one embodiment of the sensor arrangement the connector comprises at least one hole in which a screw is arranged in such a way that the connector is fixed to the carrier. The connector can be fixed to the second mounting part of the carrier by the screw. It is further possible that the connector comprises at least two holes in which each a screw is arranged in such a way that the connector is fixed to the carrier. The two holes can be arranged at opposite sides of the electrical contact. By employing two screws to fix the connector to the carrier, a stable connection can be formed.

In at least one embodiment of the sensor arrangement the connector comprises a female plug which faces a bottom side of the wheel sensor. The female plug can be arranged at a side which is different from the side where the electrical contact is arranged. The female plug can be electrically connected with the electrical contact. The bottom side of the wheel sensor can be the side which faces the ground. The female plug can be electrically connected with the wheel sensor. Therefore, the wheel sensor can be supplied with power via a power cable which is connected with the electrical contact.

In at least one embodiment of the sensor arrangement the wheel sensor comprises a male plug at the bottom side of the wheel sensor. The male plug of the wheel sensor is electrically connected with the female plug of the connector. This means, the wheel sensor is electrically connected with the connector via the male plug and the female plug. Thus, the wheel sensor can be supplied with power via a power cable which is fixed to the connector. In at least one embodiment of the sensor arrangement the bottom side of the wheel sensor faces a part of the carrier. The bottom side of the wheel sensor can face the first mounting part. This means, the bottom side of the wheel sensor is the side which faces the ground on which the sensor arrangement is arranged.

In at least one embodiment of the sensor arrangement a power cable is electrically connected to the connector. The power cable can comprise an electrical contact which is electrically connected with the electrical contact of the connector. Thus, the power cable is electrically connected with the female plug of the connector. The power cable can be fixed to the connector by molding or injection molding. The power cable can be surrounded by a plurality of wires which comprise stainless steel. Therefore, the power cable is robust against external influences, strain, gravel arranged around the rail and damages caused by animals.

The following description of figures may further illustrate and explain exemplary embodiments. Components that are functionally identical or have an identical effect are denoted by identical references. Identical or effectively identical components might be described only with respect to the figures where they occur first. Their description is not necessarily repeated in successive figures.

Figure 1B:
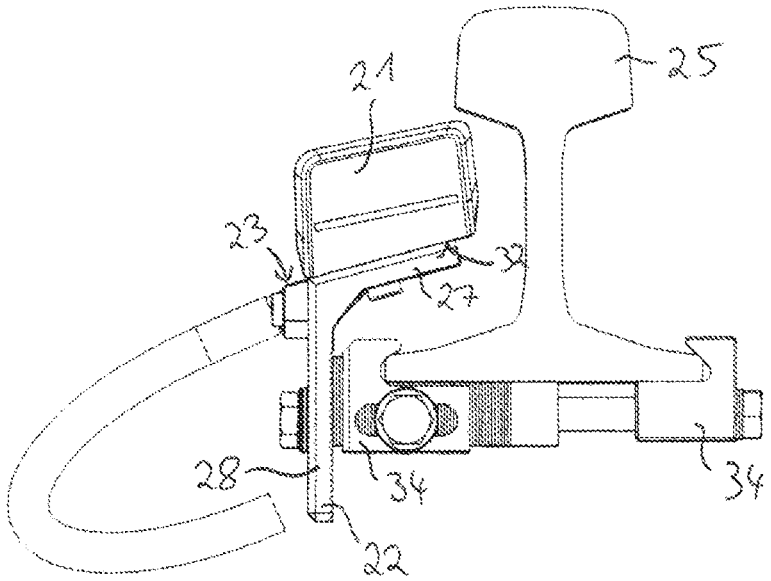
Figure 1C:
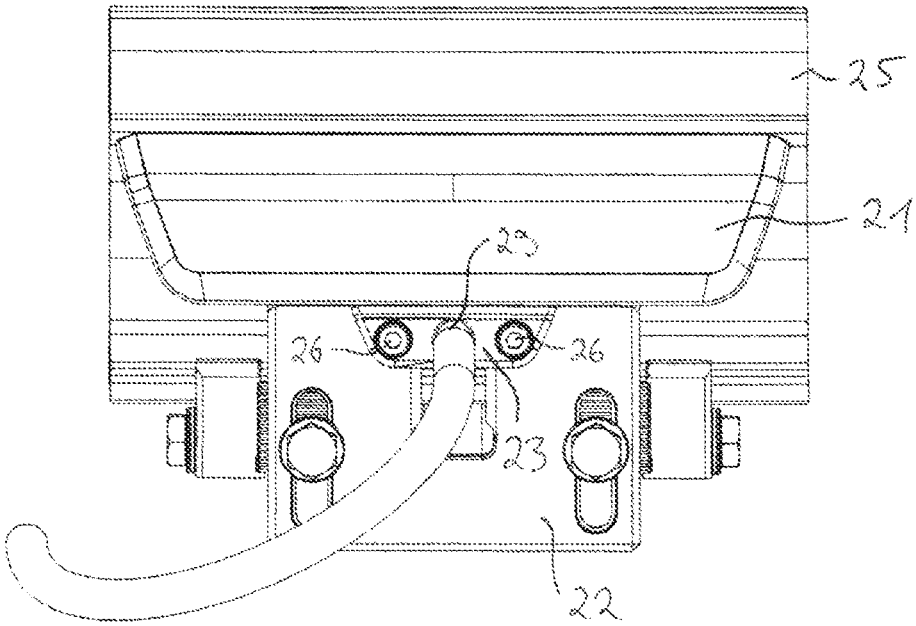

In FIGS. 1A, 1B and 1C an exemplary embodiment of a sensor arrangement is shown.

Figure 2:
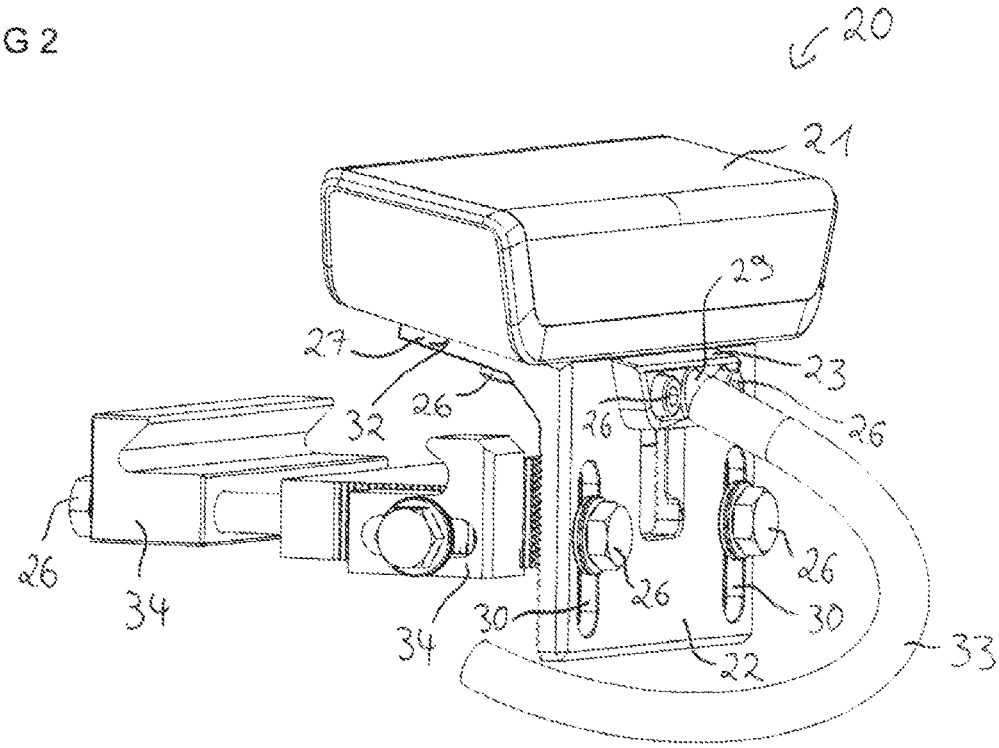

In FIG. 2 a side view of a further exemplary embodiment of a sensor arrangement is shown.

Figure 3:
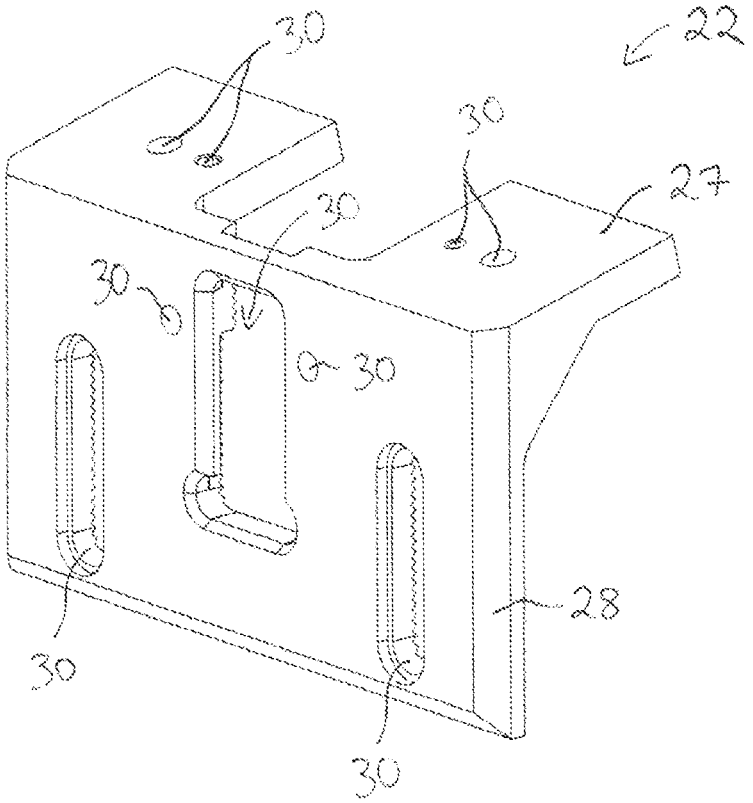

FIG. 3 shows an exemplary embodiment of a carrier.

Figure 4:
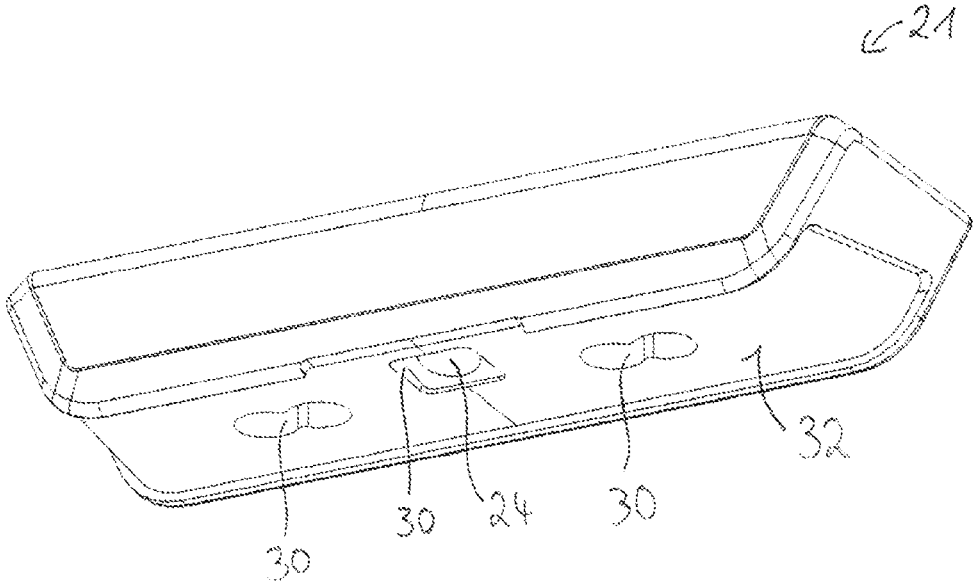

With FIG. 4 an exemplary embodiment of a wheel sensor is described.

Figure 5:
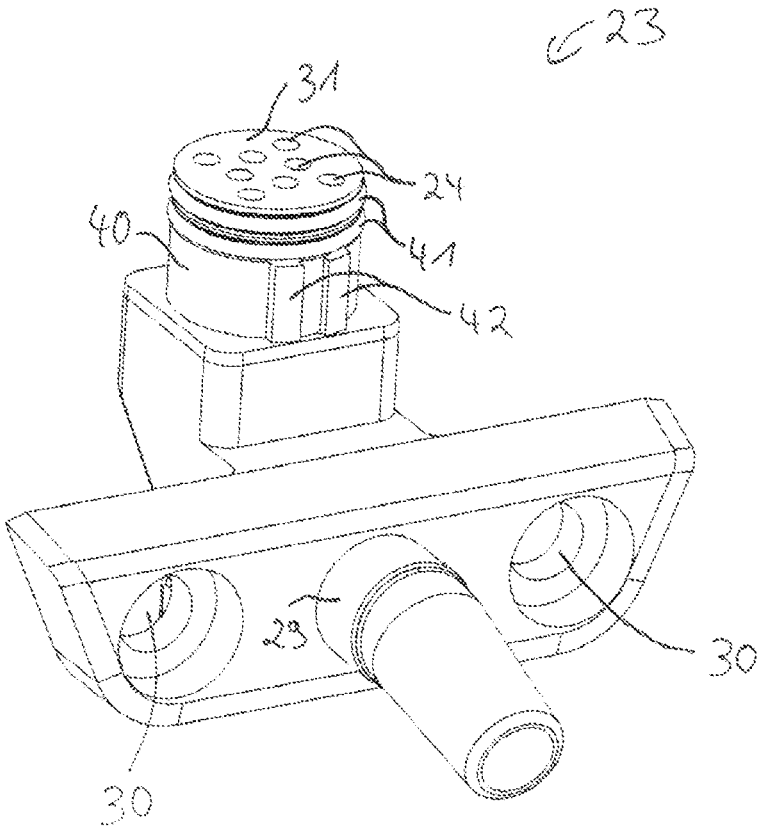

In FIG. 5 an exemplary embodiment of a connector is shown.

In FIG. 1A an exemplary embodiment of a sensor arrangement 20 is shown. The sensor arrangement 20 is fixed to a rail 25 via a clamp part 34 which is comprised by the sensor arrangement 20. The sensor arrangement 20 comprises a wheel sensor 21 which is arranged to detect wheels of rail vehicles. The wheel sensor 21 comprises two inductive sensors. The wheel sensor 21 is fixed on a carrier 22 of the sensor arrangement 20. The carrier 22 is fixed to the clamp part 34. For this purpose the carrier 22 comprises two holes 30 in which each a screw 26 is arranged to fix the carrier 22 to the clamp part 34. The two holes 30 in the carrier 22 have an elongated shape such that the position of the carrier 22 relative to the clamp part 34 can be adjusted to different heights. This means, by adjusting the position of the carrier 22 relative to the clamp part 34, the position of the wheel sensor 21 relative to the rail 25 can be adjusted.

The sensor arrangement 20 further comprises a connector 23. The connector 23 is fixed to the carrier 22. For this purpose the connector 23 comprises two holes 30 in which each a screw 26 can be arranged to fix the connector 23 to the carrier 22. The carrier 22 comprises two holes 30 as well in which the two screws 26 are arranged. This means, the connector 23 is reversibly fixed to the carrier 22 by the two screws 26. The connector 23 further comprises an electrical contact 29. The two holes 30 of the connector 23 are arranged on opposite sides of the electrical contact 29. The electrical contact 29 is arranged on a side of the carrier 22 which faces away from the rail 25. A power cable 33 can be electrically connected to the electrical contact 29.

The electrical contact 29 is arranged closer to a bottom side 32 of the carrier 22 than the wheel sensor 21. The bottom side 32 of the carrier 22 is the side of the carrier 22 which is the closest to the ground on which the sensor arrangement 20 is arranged. The bottom side 32 of the carrier 22 can be the side at which the clamp part 34 is arranged. This means, the electrical contact 29 is arranged at a lower position than the wheel sensor 21. Therefore, it is less likely that parts hanging down from a passing rail vehicle or humans or animals walking on the railway track get in contact with the power cable 33 which is connected to the electrical contact 29 of the connector 23.

The connector 23 is electrically connected with electrical contacts 24 of the wheel sensor 21. This connection is not visible in FIG. 1. The electrical contacts 24 of the wheel sensor 21 are arranged at a bottom side 32 of the wheel sensor 21, where the bottom side 32 faces the clamp part 34. The carrier 22 comprises a hole 30 through which the connector 23 extends towards the wheel sensor 21.

In FIG. 1B a side view on the embodiment shown in FIG. 1A is shown. The clamp part 34 extends below the rail 25 and is fixed to the rail 25 at both sides of the rail 25. The carrier 22 comprises a first mounting part 27 on which the wheel sensor 21 is arranged. This means, the bottom side 32 of the wheel sensor 21 is in direct contact with the first mounting part 27. The carrier 22 further comprises a second mounting part 28 to which the connector 23 is fixed. The first mounting part 27 and the second mounting part 28 are integrally connected with each other. The first mounting part 27 extends parallel to a first plane and the second mounting part 28 extends parallel to a second plane. The first plane encloses an angle of greater than zero degrees with the second plane. The first plane can enclose an angle of at least 90° with the second plane.

In FIG. 1C a further side view on the embodiment shown in FIG. 1A is shown. The viewing direction in FIG. 1C is rotated by 90° to the viewing direction in FIG. 1B. The connector 23 is fixed to the carrier 22 by two screws 26 which are arranged on opposite sides of the electrical contact 29. The two screws 26 are arranged symmetrically with respect to the electrical contact 29.

In FIG. 2 a further exemplary embodiment of the sensor arrangement 20 is shown. The clamp part 34 is fixed to the rail 25 by clamping the rail 25 from below. The rail 25 is not shown in FIG. 2. The clamp part 34 comprises two screws 26 which extend below the rail 25. The carrier 22 is fixed to the clamp part 34 by two screws 26 which extend through the two holes 30. The connector 23 is fixed to the carrier 22 by two screws 26 which are arranged on opposite sides of the electrical contact 29. A power cable 33 is connected to the electrical contact 29 of the connector 23. This means, the power cable 33 is electrically connected to the connector 23. The wheel sensor 21 is fixed to the carrier 22 by at least one screw 26. The carrier 22 comprises a hole 30 in the first mounting part 27 through which the screw 26 for fixing the wheel sensor 21 extends. The wheel sensor 21 can be fixed to the carrier 22 by two screws 26. The screws 26 for fixing the wheel sensor 21 to the carrier 22 are arranged at the bottom side 32 of the wheel sensor 21. This means, the bottom side 32 of the wheel sensor 21 faces a part of the carrier 22, namely the first mounting part 27.

In FIG. 3 an exemplary embodiment of the carrier 22 is shown. The carrier 22 comprises the first mounting part 27 in which four holes 30 are arranged in order to fix the wheel sensor 21 to the carrier 22 by screws 26. The second mounting part 28 of the carrier 22 comprises an elongated hole 30 through which the connector 23 extends when mounted. Next to the elongated hole 30 for the connector 23 two holes 30 are arranged in order to fix the connector 23 by two screws 26 to the carrier 22. As the wheel sensor 21 and the connector 23 are fixed to the carrier 22 at different positions, both components can be mounted and removed independently from each other. The carrier 22 further comprises two elongated holes 30 which are arranged on opposite sides of the hole 30 for the connector 23. In the two elongated holes 30 two screws 26 can be arranged to fix the carrier 22 to the clamp part 34. The first mounting part 27 and the second mounting part 28 enclose an angle of at least 90°.

In FIG. 4 an exemplary embodiment of the wheel sensor 21 is shown. At the bottom side 32 the wheel sensor 21 comprises two holes 30 for fixing the wheel sensor 21 to the carrier 22 via screws 26. Between the two holes 30 the wheel sensor 21 comprises a further hole 30 in which electrical contacts 24 of the wheel sensor 21 are arranged. The electrical contacts 24 are formed as a male plug.

In FIG. 5 an exemplary embodiment of the connector 23 is shown. The connector 23 comprises two holes 30 in which screws 26 can be arranged to fix the connector 23 to the carrier 22. The connector 23 further comprises the electrical contact 29. The two holes 30 are arranged on opposite sides of the electrical contact 29. The connector 23 further comprises a female plug 31 which faces the bottom side 32 of the wheel sensor 21 when mounted in the sensor arrangement 20. The female plug 31 is configured to be electrically connected to the male plug of the wheel sensor 21. The female plug 31 comprises eight electrical contacts 24. The female plug 31 is arranged in a cylinder shaped part 40 of the connector 23. The cylinder shaped part 40 comprises two recesses which extend along the circumference of the cylinder shaped part 40. The cylinder shaped part 40 is configured to fit into the hole 30 in which the male plug of the wheel sensor 21 is arranged. In the recesses sealing rings 41 or gaskets are arranged in order to protect the electrical connection between the wheel sensor 21 and the connector 23 against humidity. The cylinder shaped part 40 further comprises protrusions 42 in order to provide reverse-polarity protection.

REFERENCE NUMERALS

20: sensor arrangement
21: wheel sensor
22: carrier
23: connector
24: electrical contact
25: rail
26: screw
27: first mounting part
28: second mounting part
29: electrical contact
30: hole
31: female plug
32: bottom side
33: power cable
34: clamp part
40: cylinder shaped part
41: sealing ring
42: protrusion

The invention claimed is:

1. A sensor arrangement, comprising:
a wheel sensor which is arranged to detect wheels of rail vehicles;
a carrier; and
a connector,
wherein:
the wheel sensor is fixed on the carrier;
the connector is fixed to the carrier and is in direct contact with the carrier; and
the connector is for being electrically connected with at least one electrical contact of the wheel sensor.

2. The sensor arrangement according to claim 1, wherein the sensor arrangement is configured to be fixed to a rail.

3. The sensor arrangement according to claim 1, wherein the wheel sensor comprises an inductive sensor.

4. The sensor arrangement according to claim 1, wherein the wheel sensor is fixed to the carrier by at least one screw and wherein the at least one screw is arranged at one side of the wheel sensor.

5. The sensor arrangement according to claim 1, wherein the carrier comprises a first mounting part on which the wheel sensor is arranged.

6. The sensor arrangement according to claim 5, wherein the carrier comprises a second mounting part to which the connector is fixed.

7. The sensor arrangement according to claim 1, wherein the connector is reversibly fixed to the carrier by at least one screw.

8. The sensor arrangement according to claim 1, wherein the connector comprises an electrical contact.

9. The sensor arrangement according to claim 8, wherein the electrical contact is arranged closer to a bottom side of the carrier than the wheel sensor.

10. The sensor arrangement according to claim 8, wherein the connector comprises at least one hole in which a screw is arranged in such a way that the connector is fixed to the carrier.

11. The sensor arrangement according to claim 1, wherein the connector comprises a female plug which faces a bottom side of the wheel sensor.

12. The sensor arrangement according to claim 11, wherein the wheel sensor comprises a male plug at the bottom side of the wheel sensor.

13. The sensor arrangement according to claim 11, wherein the bottom side of the wheel sensor faces a part of the carrier.

14. The sensor arrangement according to claim 1, wherein a power cable is electrically connected to the connector.

15. The sensor arrangement according to claim 1, wherein the connector is fixed to the carrier independently from the wheel sensor.

16. The sensor arrangement according to claim 1, wherein the connector is reversibly fixed to the carrier.

17. The sensor arrangement according to claim 1, wherein the connector further comprises at least one plug.

18. The sensor arrangement according to claim 1, wherein the connector is arranged at least partially within a recess or a hole of the carrier.

19. A sensor arrangement, comprising:
a wheel sensor which is arranged to detect wheels of rail vehicles;
a carrier; and
a connector,
wherein:
the wheel sensor is fixed on the carrier;
the connector is fixed to the carrier; and
the connector is for being electrically connected with at least one electrical contact of the wheel sensor,
wherein the carrier comprises:
a first mounting part on which the wheel sensor is arranged; and a second mounting part to which the connector is fixed, and wherein the first mounting part extends parallel to a first plane which encloses an angle of greater than zero degrees with a second plane, and the second mounting part extends parallel to the second plane.

20. A sensor arrangement, comprising:

a wheel sensor which is arranged to detect wheels of rail vehicles;

a carrier; and a connector comprising:

an electrical contact; and at least one hole in which a screw is arranged in such a way that the connector is fixed to the carrier, wherein:

the wheel sensor is fixed on the carrier;

the connector is fixed to the carrier; and the connector is for being electrically connected with at least one electrical contact of the wheel sensor.

* * * * *